US008934822B2

(12) United States Patent
Mimbu et al.

(10) Patent No.: US 8,934,822 B2
(45) Date of Patent: Jan. 13, 2015

(54) TRANSFER DEVICE AND IMAGE FORMING APPARATUS

(71) Applicants: Ryuuichi Mimbu, Kanagawa (JP); Shinya Tanaka, Kanagawa (JP); Hirokazu Ishii, Kanagawa (JP); Yasunobu Shimizu, Kanagawa (JP); Keigo Nakamura, Kanagawa (JP); Hiromi Ogiyama, Tokyo (JP); Kenji Sengoku, Kanagawa (JP)

(72) Inventors: Ryuuichi Mimbu, Kanagawa (JP); Shinya Tanaka, Kanagawa (JP); Hirokazu Ishii, Kanagawa (JP); Yasunobu Shimizu, Kanagawa (JP); Keigo Nakamura, Kanagawa (JP); Hiromi Ogiyama, Tokyo (JP); Kenji Sengoku, Kanagawa (JP)

(73) Assignee: Ricoh Company, Ltd., Tokyo (JP)

( * ) Notice: Subject to any disclaimer, the term of this patent is extended or adjusted under 35 U.S.C. 154(b) by 112 days.

(21) Appl. No.: 13/646,898

(22) Filed: Oct. 8, 2012

(65) Prior Publication Data

US 2013/0089363 A1 Apr. 11, 2013

(30) Foreign Application Priority Data

Oct. 11, 2011 (JP) ..... 2011-224183
Jan. 31, 2012 (JP) ..... 2012-018686
Apr. 27, 2012 (JP) ..... 2012-102413

(51) Int. Cl.
*G03G 15/20* (2006.01)
*G03G 21/00* (2006.01)
*G03G 15/16* (2006.01)

(52) U.S. Cl.
CPC ..... *G03G 15/168* (2013.01)
USPC ..... 399/314; 399/346

(58) Field of Classification Search
USPC ..... 399/314, 66, 346
See application file for complete search history.

(56) References Cited

U.S. PATENT DOCUMENTS

| | | | |
|---|---|---|---|
| 5,483,330 | A | 1/1996 | Ogiyama et al. |
| 5,515,146 | A | 5/1996 | Harasawa et al. |
| 5,631,725 | A | 5/1997 | Harasawa et al. |
| 5,812,919 | A | 9/1998 | Takano et al. |
| 5,822,667 | A | 10/1998 | Hayama et al. |
| 5,930,573 | A | 7/1999 | Miyamoto et al. |
| 6,188,862 | B1 | 2/2001 | Ishii |
| 6,282,386 | B1 | 8/2001 | Ishii |
| 2002/0034406 | A1 | 3/2002 | Kawagoe et al. |
| 2003/0016968 | A1 | 1/2003 | Takahashi et al. |
| 2003/0026625 | A1 | 2/2003 | Tamiya et al. |

(Continued)

FOREIGN PATENT DOCUMENTS

| | | |
|---|---|---|
| CN | 101339401 | 1/2009 |
| JP | 09-166923 | 6/1997 |

(Continued)

OTHER PUBLICATIONS

Chinese Office Action dated Nov. 4, 2014 for corresponding Chinese Application No. 201210380376.0.

*Primary Examiner* — Walter L Lindsay, Jr.
*Assistant Examiner* — Rodney Bonnette
(74) *Attorney, Agent, or Firm* — Oblon, Spivak, McClelland, Maier & Neustadt, L.L.P.

(57) ABSTRACT

A transfer device comprises a freely rotatable transferring member contacting an image bearing member to form a transfer nip therebetween; a transfer bias applying member to apply a first bias created by superimposing an alternating current component on a direct current component to the transferring member to transfer a toner image borne on the image bearing member to a recording medium in the transfer nip; and an applicator to apply a protective agent to a surface of the transferring member.

19 Claims, 8 Drawing Sheets

(56) References Cited

U.S. PATENT DOCUMENTS

| | | | | |
|---|---|---|---|---|
| 2003/0035658 | A1 | 2/2003 | Ishii | |
| 2003/0035660 | A1 | 2/2003 | Sugino et al. | |
| 2003/0118359 | A1 | 6/2003 | Ogiyama et al. | |
| 2003/0219287 | A1 | 11/2003 | Ogiyama et al. | |
| 2003/0219296 | A1 | 11/2003 | Kabata et al. | |
| 2004/0105692 | A1 | 6/2004 | Tamiya et al. | |
| 2004/0136760 | A1 | 7/2004 | Yoshida et al. | |
| 2004/0160646 | A1 | 8/2004 | Kudo et al. | |
| 2004/0165919 | A1* | 8/2004 | Nishida | 399/346 |
| 2004/0228663 | A1 | 11/2004 | Kamiya et al. | |
| 2005/0013636 | A1 | 1/2005 | Sawai et al. | |
| 2005/0180767 | A1 | 8/2005 | Ishii et al. | |
| 2006/0056884 | A1 | 3/2006 | Sawai et al. | |
| 2006/0127116 | A1 | 6/2006 | Ogiyama et al. | |
| 2007/0003333 | A1 | 1/2007 | Ishii | |
| 2007/0014597 | A1 | 1/2007 | Ishii | |
| 2007/0127941 | A1 | 6/2007 | Ishii et al. | |
| 2007/0258737 | A1 | 11/2007 | Ogiyama et al. | |
| 2008/0124155 | A1 | 5/2008 | Mimbu | |
| 2008/0232867 | A1 | 9/2008 | Minbu et al. | |
| 2009/0060611 | A1 | 3/2009 | Minbu | |
| 2009/0142083 | A1 | 6/2009 | Minbu | |
| 2010/0008687 | A1 | 1/2010 | Ishii | |
| 2010/0080631 | A1 | 4/2010 | Ogiyama et al. | |
| 2010/0142985 | A1 | 6/2010 | Minbe et al. | |
| 2010/0221029 | A1 | 9/2010 | Minbu et al. | |
| 2011/0064487 | A1 | 3/2011 | Ichihashi et al. | |
| 2011/0158690 | A1 | 6/2011 | Mimbu et al. | |
| 2011/0229168 | A1 | 9/2011 | Shiraishi et al. | |
| 2011/0286759 | A1 | 11/2011 | Ichihashi et al. | |
| 2011/0293312 | A1 | 12/2011 | Mimbu et al. | |
| 2012/0003017 | A1 | 1/2012 | Minbu | |
| 2012/0008991 | A1 | 1/2012 | Shimizu | |
| 2012/0045231 | A1 | 2/2012 | Ogino et al. | |
| 2012/0045237 | A1 | 2/2012 | Aoki et al. | |
| 2012/0045259 | A1 | 2/2012 | Nakamura et al. | |
| 2012/0121293 | A1 | 5/2012 | Mimbu et al. | |
| 2012/0170951 | A1 | 7/2012 | Ishii | |
| 2012/0224879 | A1 | 9/2012 | Fujita et al. | |
| 2012/0230715 | A1 | 9/2012 | Ogino et al. | |
| 2012/0237234 | A1* | 9/2012 | Sugimoto et al. | 399/50 |
| 2012/0237260 | A1 | 9/2012 | Sengoku et al. | |
| 2012/0243892 | A1 | 9/2012 | Nakamura et al. | |
| 2012/0308250 | A1* | 12/2012 | Shimizu et al. | 399/66 |
| 2012/0315058 | A1 | 12/2012 | Shimizu et al. | |
| 2012/0321336 | A1 | 12/2012 | Ogiyama | |
| 2012/0328314 | A1 | 12/2012 | Sugimoto et al. | |
| 2012/0328320 | A1 | 12/2012 | Fujita et al. | |
| 2013/0004190 | A1 | 1/2013 | Sengoku et al. | |
| 2013/0011155 | A1 | 1/2013 | Ogiyama et al. | |
| 2013/0016989 | A1* | 1/2013 | Fujita et al. | 399/88 |

FOREIGN PATENT DOCUMENTS

| | | |
|---|---|---|
| JP | 2006-267486 | 10/2006 |
| JP | 2008-058585 | 3/2008 |

* cited by examiner

| | DIRECT CURRENT TRANSFER MODE | | SUPERIMPOSITION TRANSFER MODE | |
|---|---|---|---|---|
| | SURFACE PROTECTION AGENT PRESENT | SURFACE PROTECTION AGENT ABSENT | SURFACE PROTECTION AGENT PRESENT | SURFACE PROTECTION AGENT ABSENT |
| WHITE LINE INCLUDED IMAGE | ○ | ○ | ○ | × |
| BACKSIDE STEIN INCLUDED IMAGE | ○ | ○ | ○ | × |

FIG. 11

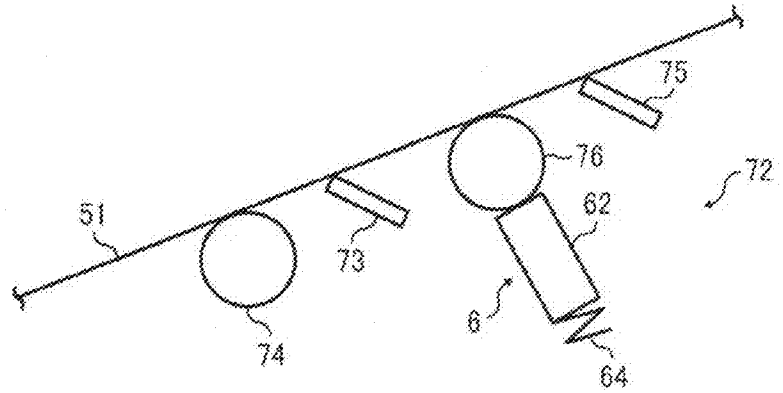

FIG. 12

| | DIRECT CURRENT TRANSFER MODE | | | SUPERIMPOSITION TRANSFER MODE | | |
|---|---|---|---|---|---|---|
| THE NUMBER OF ROTATIONS OF BRUSH | 200rpm | 400rpm | 600rpm | 200rpm | 400rpm | 600rpm |
| WHITE TURBIDNESS ON SURFACE OF TRANSFER ROLLER | ○ | ○ | ○ | × | ○ | ○ |
| BACKSIDE STEIN INCLUDED IMAGE | ○ | ○ | ○ | × | × | ○ |
| SURFACE FRICTION COEFFICIENT BETWEEN TRANSFER ROLLER AND SHEET | 0.22 | 0.21 | 0.21 | 0.55 | 0.45 | 0.21 |
| CONSUMPTION AMOUNT OF SURFACE PROTECTION AGENT PER UNIT LENGTH (mg/cm) | 0.9 | 1.9 | 2.7 | 0.9 | 1.9 | 2.7 |

×: OCCURRENCE ○: NON-OCCURRENCE

TRANSFER DEVICE AND IMAGE FORMING APPARATUS

CROSS-REFERENCE TO RELATED APPLICATIONS

This patent application is based on and claims priority pursuant to 35 U.S.C.§119 to Japanese Patent Application Nos. 2011-224183, 2012-018686, and 2012-102413, filed on Oct. 11, 2011, Jan. 31, 2012, and Apr. 27, 2012, respectively, in the Japanese Patent Office, the entire disclosures of which are hereby incorporated by reference herein.

BACKGROUND OF THE INVENTION

1. Field of the Invention

This invention relates to a transfer device and an image forming apparatus, such as a copier, a printer, etc., incorporating the transfer device.

2. Description of the Background Art

In a conventional image forming apparatus employing an electro-photographic system, an electrostatic latent image is formed in accordance with optical image information on an image bearing member uniformly charged previously and is developed into a visible toner image by toner supplied from a developing device. The visible image is then transferred and fixed onto a recording sheet thereby completing image formation.

However, the surface of the recording sheet bears asperities and is more or less uneven. Accordingly, less toner is transferred onto concavities in the surface of the recording medium than onto convexities therein. Especially, when the recording sheet is very rough, that is, exhibits substantial differences between concavity and convex portions, the toner is not transferred onto the concavities and generates dropouts in the output image as a result.

As a solution to the above-described problem, a transfer rate e of toner can be upgraded by using a transfer bias consisting not of a direct current voltage alone but instead one created by superimposing an alternating current voltage on a direct current voltage as disclosed in Japanese Patent Application Publication Nos. 2006-267486 (JP-2006-267486-A) and 2008-58585 (JP-2008-58585-A). Specifically, the technology disclosed in JP-2006-267486-A utilizes a transfer bias created by superimposing the alternating current voltage on the direct current voltage, and charges a surface of the recording sheet to an opposite polarity to that of toner in accordance with the unevenness of the surface of the recording sheet to transfer the toner onto concavities. Similarly, the technology disclosed in JP-2008-58585-A also utilizes a transfer bias created by superimposing the alternating current voltage on the direct current voltage so that a P-P (Peak to Peak) value of the alternating current voltage is less than twice of the direct current voltage.

However, using a transfer bias created by superimposing the alternating current voltage on the direct current voltage creates more corona products, such as nitrogen oxides, ozone, etc., generated in a discharge process increase when the transfer bias created by superimposing the alternating current voltage on the direct current voltage is used than when only the direct current voltage is used as the transfer bias, because reverse discharging occurs between an intermediate transferring member and a transferring member, and the frequency of discharging times is much greater than when only direct current is used. As the corona products build up inside the image formation apparatus, highly concentrated ozone causes cracks in and accelerates degradation of transferring members (e.g., rubber) shortening the life of constituent parts of the apparatus. Further, nitrogen oxide reacts with moisture in the air and with metal or the like generating nitric acid and metal nitric acid, respectively. These products have a high electrical resistance in low-humidity environments, but react with water in the air and have a low resistance at high temperatures. Thus, these products form a thin film on the surface of the transferring members, and transfer current concentrates at the thin film, resulting in output of abnormal images, i.e., images in which white lines etc., appear.

When a cleaner is used to clean a surface of the transferring member, cleaning performance significantly deteriorates in a portion where the thin film of the above-described products is formed. Specifically, toner adhered to the surface of the transferring member cannot be removed therefrom, thereby causing a back side stain on a transfer medium as a problem.

Further, use of a cleaner to clean the surface of the image bearing member causes a significant deterioration in cleaning performance significantly deteriorates at portions where the above-described corona products is formed. Further, toner adhering to the surface of the image bearing member cannot be removed therefrom and thus soils the transfer recording medium as a result. The same problem arises with a use of a cleaner to clean the surface of the image bearing member.

BRIEF SUMMARY OF THE INVENTION

Accordingly, the present invention provides a novel transfer device that comprises a freely rotatable transferring member contacting an image bearing member to form a transfer nip, a transfer bias applying member to transfer the toner image borne on the image bearing member onto the recording medium in the transfer nip by applying a first bias that is created by superimposing an alternating current component on a direct current component, and a first applicator to apply a first protective agent to a surface of the transferring member.

In another aspect of the present invention, the transfer bias applying member may selectively apply either the first bias or a second bias composed only of the direct current component. And, the first applicator may apply more first protective agent when the first bias is applied than when the second bias is applied.

In yet another aspect of the present invention, the applicator may include a rotatable application element in contact with both the first protective agent and the transferring member to scrape off and apply the first protective agent to the transferring member.

In yet another aspect of the present invention, a rotational speed of the application element may be increased when at least the first bias is applied.

In yet another aspect of the present invention, pressure of contact between the application element and the protective agent may be increased when at least the first bias is applied.

In yet another aspect of the present invention, the application element may be a first brush roller.

In yet another aspect of the present invention, the first protective agent may be zinc stearate.

In yet another aspect of the present invention, the first brush roller may be made of polyester fiber.

In yet another aspect of the present invention, the first brush roller may further include a first cleaner to clean the transferring member.

In yet another aspect of the present invention, the above-described transfer device may further include a second brush roller disposed in contact with the surface of the transferring member on an upstream side of the first cleaner in a direction of rotation of the transferring member.

In yet another aspect of the present invention, at least a surface of the transferring member may be made of fluorine resin.

The present invention further provides an image forming apparatus that includes an image bearing member and the above-described transfer device.

In yet another aspect of the present invention, the above-described image forming apparatus may further include a second cleaner to contact and clean a surface of the image bearing member and a second applicator to apply a second protective agent to the surface of the image bearing member.

In yet another aspect of the present invention, the transfer bias applying member may selectively apply either the first bias or a second bias composed only of the direct current component. Further, the second applicator may apply more second protective agent when the first bias is applied.

In yet another aspect of the present invention, the second applicator may include a second rotatable application element in contact with both the second protective agent and the image bearing member to scrape off and apply the second protective agent to the image bearing member.

In yet another aspect of the present invention, a rotational speed of the second application element may be increased when at least the first bias is applied.

In yet another aspect of the present invention, the pressure of contact between the second application element and the second protective agent may be increased when at least the first bias is applied.

In yet another aspect of the present invention, the second application element may be a third brush roller.

In yet another aspect of the present invention, the second protective agent may be zinc stearate.

In yet another aspect of the present invention, the third brush roller may be made of polyester fiber.

BRIEF DESCRIPTION OF THE DRAWINGS

A more complete appreciation of the present invention and many of the attendant advantages thereof will be more readily obtained as the same becomes better understood by reference to the following detailed description when considered in connection with the accompanying drawings, wherein:

FIG. 11 is a schematic diagram illustrating a belt cleaner used in the other embodiment of the present invention shown in FIG. 10; and FIG. 12 is a table illustrating results of image formation executed in direct current transfer and superposition transfer modes while changing the number of revolutions of a brush roller provided in yet another embodiment of the present invention.

DETAILED DESCRIPTION OF THE INVENTION

Figure 1:
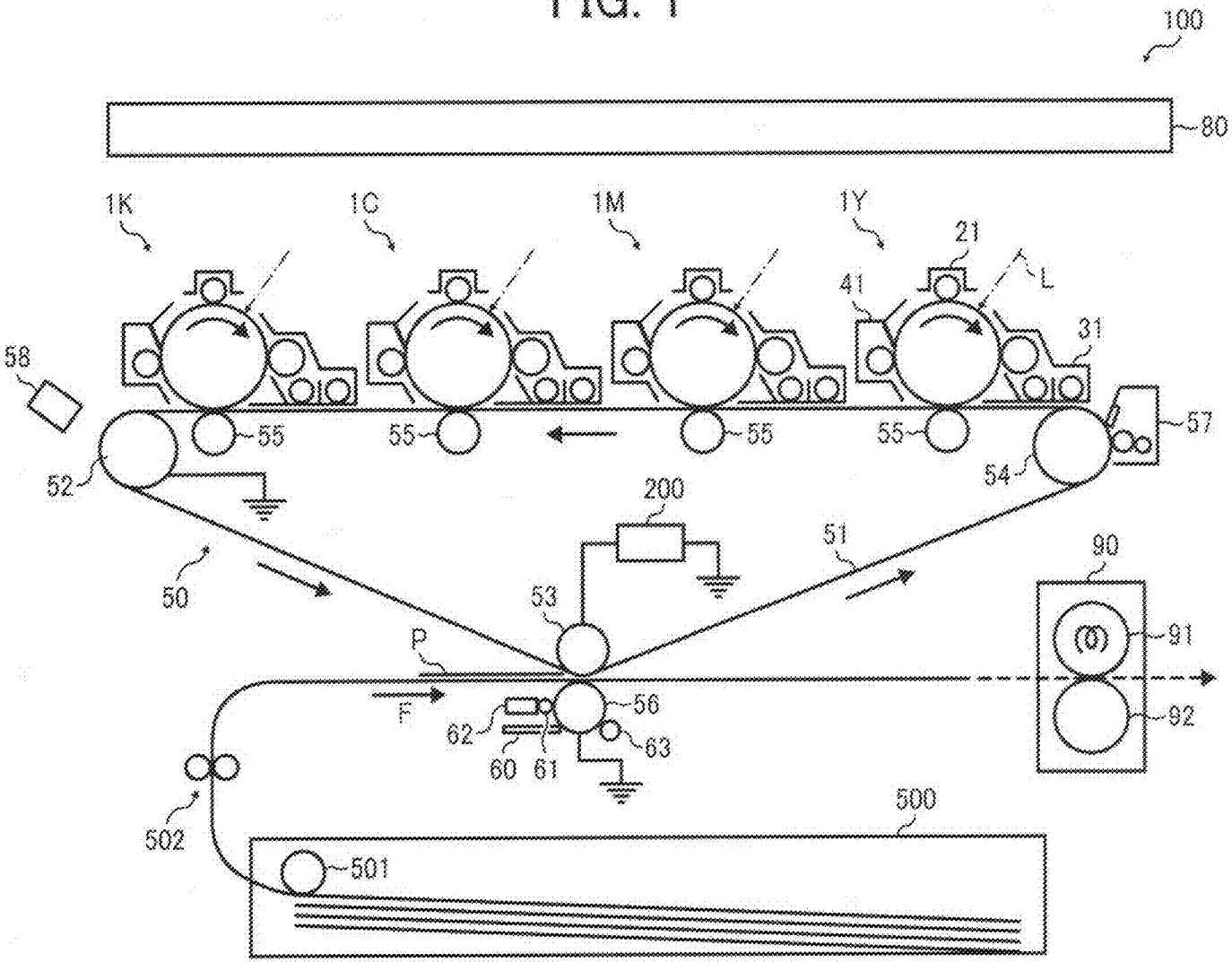
FIG. 1 is a schematic diagram illustrating an image forming apparatus to which one embodiment of the present invention is applied.

Referring now to the drawings, wherein like reference numerals designate identical or corresponding parts throughout the several views thereof and in particular to FIG. 1, a color printer 100 is illustrated as an image forming apparatus adopting an intermediate transfer system, to which one embodiment of the present invention is applied. Specifically, the color printer 100 has an intermediate transfer belt 51 mainly consisting of an endless belt as an intermediate transferring member, and four image forming units 1Y, 1M, 1C, and 1K constituting a tandem image formation system forming color toner images of yellow (Y), magenta (M), cyan (C), and black (K), respectively, along an upper running side of the intermediate transfer belt 51.

Figure 2:
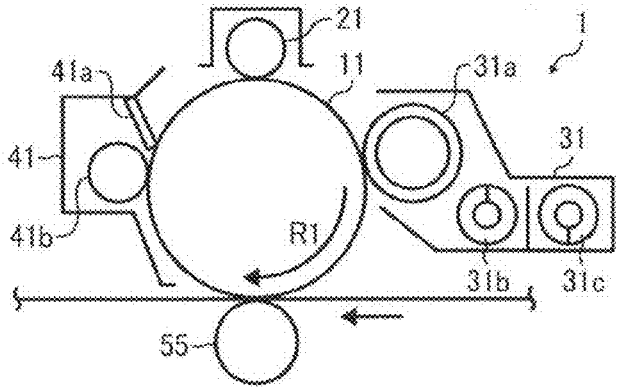
FIG. 2 is a schematic diagram illustrating an image forming unit provided in the image forming apparatus to which one embodiment of the present invention is applied.

Since each of the image forming units 1Y, 1M, 1C, and 1K has the same configuration and is only different in toner color handled, only one of the image forming units is typically described with reference to FIG. 2. As shown there, the image forming unit 1 has a photoconductive drum 11 as an image bearing member, a discharger 21 to charge a surface of the photoconductive drum 11 with a charging roller, and a developing device 31 to visualize an electrostatic latent image formed on the photosensitive drum 11. The image forming unit 1 also has a transfer roller 55 as a primary transfer device to transfer a toner image from the photoconductive drum 11 onto the intermediate transfer belt 51, and a cleaner 41 to clean the surface of the photosensitive drum 11. In this embodiment, each of the image forming units 1Y, 1M, 1C, and 1K is configured to be detachably attached to an apparatus body.

The photoconductive drum 11 employed in this embodiment has a drum shape with an outer diameter of about 60 mm and is constituted by a drum substrate and an organic photosensitive layer formed on the surface of the drum substrate. The photoconductive drum 11 is driven clockwise by a driving device, not shown, in FIG. 2. The discharger 21 causes the charging roller provided with a charging bias to uniformly discharge a surface of the photoconductive drum 11 by either approximating or bringing the charging roller in contact with the photoconductive drum 11. In this embodiment, the surface is charged by the discharging roller in the same polarity (e.g., a negative polarity) as a normal charge polarity of toner. The charging bias applied to the discharging roller is created by superimposing an alternating current voltage on a direct current voltage. However, it is note that a system using a charger may be employed in lieu of the charging roller.

The developing unit 31 includes a developing sleeve 31*a* as a developer bearer and a pair of screw members 31*c* and 31*b* collectively serving as a stirring unit to stir and carry developer in a container accommodating two-component developer consisting of toner and carrier. Further, it is noted that a developing device using one-component developer may be employed. The cleaner 41 has a cleaning blade 41*a* and a cleaning brush 41*b*. The cleaning blade 41*a* contacts the photoconductive drum 11 in a direction counted to that in which the photoconductive drum 11 rotates to clean the surface of the photosensitive drum 11. The cleaning brush 41*b* also contacts the photoconductive drum 11 while rotating in the opposite direction to that the photoconductive drum 11 rotates to clean the surface of the photosensitive drum 11.

Above the image forming units 1Y, 1M, 1C, and 1K, an optical writing unit 80 is disposed as a latent image writing device. The optical writing unit 80 provides light scanning to each of the photoconductive drums 11Y, 11M, 11C, and 11K by emitting laser light L from a laser diode in accordance with image information transmitted from an external device, such as a personal computer, etc. With the optical scanning, each of electrostatic latent images of yellow, magenta, cyan, and black is formed on each of the photoconductive drums 11Y, 11M, 11C, and 11K. Specifically, a potential on a portion where the laser light L is irradiated among the entirely uniformly charged surface of the photoconductive drums 11 attenuates. Hence, the potential of the laser light irradiated portion smaller than that of the other portion (i.e., a background section) serves as an electrostatic latent image. Furthermore, the optical writing unit 80 polarizes the laser light L emitted from the light source in a main direction with a polygon mirror driven by a polygon motor, not shown, and further irradiates the thus polarized laser light L to the photoconductive drum 11 through multiple optical lenses and mirrors. Further, a system capable of executing optical writing with LED lights emitted from multiple LEDs provided in an LED array can be employed.

Below each of the image forming units 1Y, 1M, 1C, and 1K, a transfer unit 50 is disposed as the transfer device suspending and circulating an intermediate transfer belt 51 as an image bearing member counterclockwise in FIG. 1. In addition to the intermediate transfer belt 51, the transfer unit 50 includes a driving roller 52, a secondary transfer roller opposed roller 53, a cleaning backup roller 54, four primary transfer rollers 55, a secondary transfer roller 56, a belt cleaner 57, and a potential sensor 58 or the like.

The intermediate transfer belt 51 is stretched by a driving roller 52, a secondary transfer back roller 53, a cleaning backup roller 54, and four primary transfer rollers 55 each placed inside a loop thereof. The intermediate transfer belt 51 is circulated by rotary power of the driving roller 52 driven by a driving device, not shown, counterclockwise in FIG. 1. As the intermediate transfer belt 51, carbon dispersed polyimide resin having a thickness of from about 20 μm to about 200 μm, preferably about 60 μm, and a volumetric resistivity of from about $1\times10^{6}\Omega$cm to about $1\times10^{12}\Omega$cm, preferably about $1\times10^{9}\Omega$cm (measured by Hiresta UP Model MCP-HT45 manufactured by Mitsubishi Chemical Co., Ltd. under condition of 100V) is desirably used.

The four primary transfer rollers 55 sandwich the intermediate transfer belt 51 traveling and moving in a prescribed direction with photoconductive drums 11, respectively, thereby forming primary transfer nips for Y, M, C, and K at contacts where surfaces of the intermediate transfer belt 51 contacts the photoconductive drums 11, respectively. Multiple transfer bias power supplies, not illustrate, supply primary transfer biases to the primary transfer rollers 55, respectively. Hence, a transfer electric field is formed between each color toner image on the photoconductive drum 11 and each primary transfer roller 55, so that the toner image can be primarily transferred by the functions of the transfer electric field and nip pressure from the photoconductive drum 11 onto the intermediate transfer belt 51. At that moment, when the magenta, cyan, and black images are sequentially superimposed on the yellow toner image, a four-color superposed toner image is formed on the intermediate transfer belt 51.

When forming a black and white image (i.e., a monochromatic image), supporters, not shown, supporting the primary transfer rollers 55Y, 55M, and 55C in the transfer unit 50 is moved, respectively, so that the primary transfer rollers 55Y, 55M, and 55C are distanced from the photoconductive drums 11Y, 11M, and 11C. Hence, the surface of the intermediate transfer belt 51 is separated from the photoconductive drums 11Y, 11M, and 11C, so that the intermediate transfer belt 51 only contacts the photoconductive drum 11K. In such a situation, only the image forming unit 1K is operated to form a black toner image on the photoconductive drum 11K among the image forming units 1 Y, 1 M, 1C and 1K.

The primary transfer roller 55 is an elastic roller having an outer diameter of about 16 mm mainly consisting of a metal-core having a diameter of about 10 mm and a conductive sponge layer fixed overlying the surface of the metal-core. A resistance value R of the sponge layer is approximately $3\times10^{7}\Omega$ when calculated based on current I flowing through the sponge layer when a grounded metal roller having an outer diameter of about 30 mm is pressed against the sponge layer by force of 10N under application of a bias voltage 1000V to the core metal of the primary transfer roller 55 using the ohm's law (R=V/I). The primary transfer bias is then applied to such a primary transfer roller 55 under constant-current control. Instead of the transfer roller, a transfer brush or a transfer charger and the like may be adopted.

The secondary transfer roller 56 is disposed outside the loop of the intermediate transfer belt 51, and holds the intermediate transfer belt 51 together with the secondary transfer opposed roller 53 arranged inside the loop. Hence, a secondary transfer nip is formed as a contact where a front surface of the intermediate transfer belt 51 contacts the secondary transfer roller 56. Thus, the secondary transfer roller 56 is grounded. Whereas, the secondary transfer opposed roller 53 as an opposed member receives a secondary transfer bias from the secondary transfer power supply 200. Consequently, a second transfer electric field is formed between the secondary transfer opposed roller 53 and the secondary transfer roller 56 to electrostatically move toner from the secondary transfer opposed roller 53 to the secondary transfer roller 56.

Below the transfer unit 50, a sheet feed cassette 500 accommodating multiple recording sheets P piled up as a bunch of sheets is disposed. In the sheet feed cassette 500, a sheet feed roller 301 contacts the topmost recording sheet P of the bunch of sheets, and pumps out the recording sheet P toward a sheet feed path by driving the sheet feed roller 301 at a prescribed time. Near the end of the sheet feed path, a pair of registration rollers 502 is disposed. The pair of registration rollers 502 immediately stops its rotation when pinching the recording sheet P sent from the sheet feed cassette 500 therebetween. Subsequently, the pair of registration rollers 502 is rotated and sends the recording sheet P towards the secondary transfer nip at a prescribed time to synchronize with a toner image on the intermediate transfer belt 51 in the secondary transfer nip. The toner image on the intermediate transfer belt 51 tightly contacts the recording sheet P and is transferred onto the recording sheet P at once in the secondary transfer nip by functions of the secondary transfer electric field and nip pressure. The recording sheet P with either a full-color toner image or a monochrome toner image on its surface then passes through the secondary transfer nip and is separated from both the secondary transfer roller 56 and the intermediate transfer belt 51 due to curvature thereof.

Figure 6:
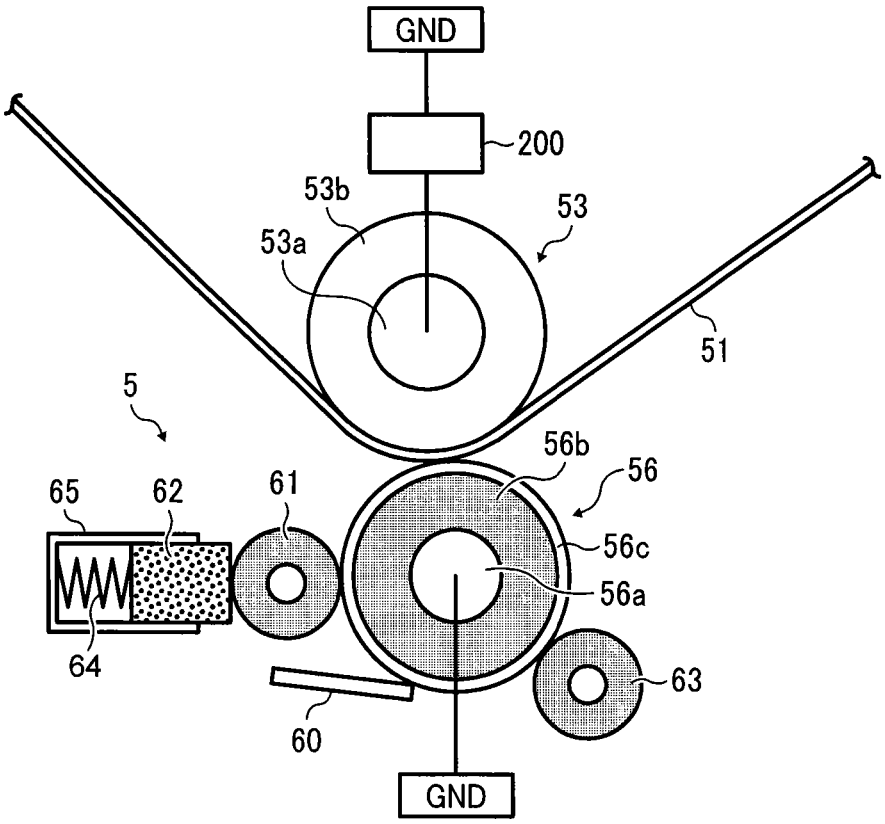
FIG. 6 is a schematic diagram illustrating a first embodiment of the present invention.

Now, the second transfer opposed roller 53 is described more in detail with reference to FIG. 6. As shown, the second transfer opposed roller 53 is constituted by a laminate made of a core metal 53*a* made of stainless steel or aluminum and the like and a resistance layer 53*b*. The resistance layer 53*b* is made of rubber, such as polycarbonate, silicone rubber, fluorine rubber, etc., with dispersion of conductive particles, such as carbon, metal complexes, etc., or semi-conductive rubber, such as NBR or EPDM rubber, NBR/ECO copolymer rubber, polyurethane, etc. A volume resistivity of the resistance layer 53*b* is from about $10^6\Omega$ to about $10^{12}\Omega$, preferably from about $10^7\Omega$ to about $10^9\Omega$. The resistance layer 53*b* may be either a foam type having a rubber hardness of from about 20 degrees to about 50 degrees or a rubber type having the rubber hardness of from about 30 degrees to about 60 degrees. However, the sponge type is desirable, because a non-contact portion does not appear even if the resistance layer 53*b* contacts the secondary transfer roller 56 via the intermediate transfer belt 51 and contact pressure is accordingly weak. Further because, as the contact pressure 51 between the intermediate transfer belt 51 and the secondary transfer opposed roller 53 increases, dropout easily occurs in a character image or a thin line image. However, the sponge type can suppress such dropout.

Further, as shown in FIG. 6, the secondary transfer roller 56 is constituted by a laminate made of a core metal 56A made of stainless steel or aluminum or the like, a resistance layer 56 made of conductive rubber or the like, and a surface layer 56*c*. In this embodiment, a diameter of the secondary transfer roller 56 is about 20 mm. The resistance layer 56*b* is made of rubber, such as copolymer of NBR/ECO, etc., having a hardness of from about 40 degrees to about 60 degrees (JIS-A). The metal core 56A is made of stainless-steel having a diameter of about 16 mm. The surface layer 56*c* consists of fluorinated urethane-elastomer desirably having a thickness of from about 8 μm to about 24 μm. That is, the surface layer 56*c* is frequently produced by a coating process, and uneven coating largely impacts on irregularity of resistance when the thickness of the surface layer 56*c* is equal to or less than 8 μm, so that leakage likely undesirably occurs at a low resistance portion thereof. In addition, wrinkle appears on a roller surface and accordingly the surface layer 56*c* is likely cracked as a problem. Whereas, when the thickness of the surface layer 56*c* exceeds about 24 μm, the resistance highly increases. Therefore, when a volume resistivity is high and a constant current is applied to the core metal of the secondary transfer opposed roller 53, a voltage sometimes increases. Consequently, the voltage sometimes exceeds a voltage variable range of a constant-current supply so that an amount of current becomes below a target. Otherwise, when the voltage variable range is wide enough, either a high voltage route starting from the constant-current power supply to the metal core of the secondary transfer opposed roller 53 or the metal core of the secondary transfer opposed roller 53 induces a high voltage thereby easily generating leakage. In addition, when the thickness of the surface layer 56*c* of the secondary transfer roller 56 exceeds 24 μm, since the hardness thereof increases, adhesion performance of adhering to a recording medium and an intermediate transfer belt 51 deteriorates as a problem. Further, a surface resistance of the secondary transfer roller 56 is equal to or more than $10^{6.5}\Omega$. The volume resistivity of the surface layer 56*c* of the secondary transfer roller 56 is equal to or more than about $10^{10}\Omega\cdot$cm, and more preferably equal to or more than about $10^{12}\Omega\cdot$cm.

An electric potential sensor 58 is disposed outside the loop of the intermediate transfer belt 51. More specifically, the electric potential sensor 58 is arranged at a winding section wound by the driving roller 52 grounded among the whole circumferential region of the intermediate transfer belt 51 via a gap of about 4 mm. The electric potential sensor 58 measures a surface potential of a toner image primarily transferred onto the intermediate transfer belt 51 when it enters an opposing position. As the potential sensor 58, EFS-22D manufactured by TDK Corporation is used in this embodiment.

On the right side of the secondary transfer nip, a fixing device 90 is disposed as shown FIG. 1. The fixing device 90 includes a fixing roller 91 incorporating a heat source, such as a halogen lamp, etc., and a rotating pressing roller 92 contacting the fixing roller 91 under given pressure while forming a fixing nip therebetween. A recording sheet P sent into the fixing device 90 is sandwiched in the fixing nip with its unfixed toner bearing surface tightly contacting the fixing roller 91. The toner in the toner image is softened by impact of pressure and heat, so that a full-color image is fused onto the recording sheet P. The recording sheet P is discharged from the fixing device 90 and is ejected to an outside after passing through a post fixing transport path. Further, residual toner is removed from the intermediate transfer belt 51 after an image transfer process by a belt cleaner 57 and is prepared for the next image formation.

Further, a secondary transfer-bias power supply 200 used in this embodiment is configured from a direct current power supply to output a direct current component, and an alternating current power supply (i.e., superposed power supply) to output a superposition obtained by superimposing an alternating current component onto the direct current component. Thus, the secondary transfer-bias power supply 200 is enabled to output the direct current voltage (hereinafter simply referred to as the direct current bias) and a superposition (hereinafter simply referred to as a superposed bias) obtained by superimposing the alternating current voltage onto the direct current voltage as the second transfer bias.

Figure 3A:
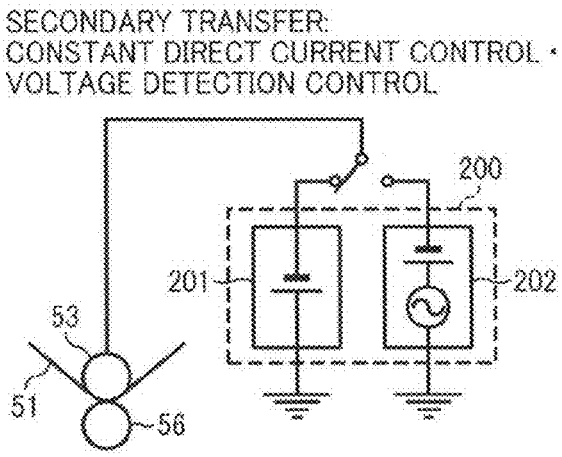
FIGS. 3A and 3B are schematic diagrams collectively illustrating an aspect of one embodiment of the present invention, in which a superposed bias and a direct current bias are selectively applied to a secondary transfer section.
Figure 3B:
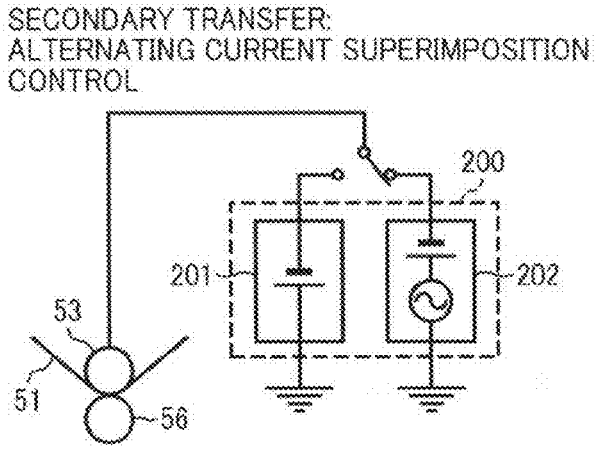

Now, an aspect in which the superposed bias and the direct current bias are switched and applied to a secondary transfer section, i.e., the secondary transfer opposed roller 53 in this embodiment, is described with reference to FIGS. 3A and 3B. Specifically, as shown there, the second transfer bias power supply 200 is constituted by a direct current power supply 201 and an alternating current power supply (i.e., a superposed power supply) 202. An aspect in which the direct current bias is applied from the direct current power supply 201 is illustrated in FIG. 3A, whereas that the superposed bias is applied from the alternating current power supply 202 is illustrated in FIG. 3B. As shown, a switch is used to conceptually illustrate switching operation between the direct current power supply 201 and the alternating current power supply 202 in the drawing. However, a pair of relays is also employed to execute the switching operation in this embodiment as described later with reference to FIG. 5.

Figure 4:
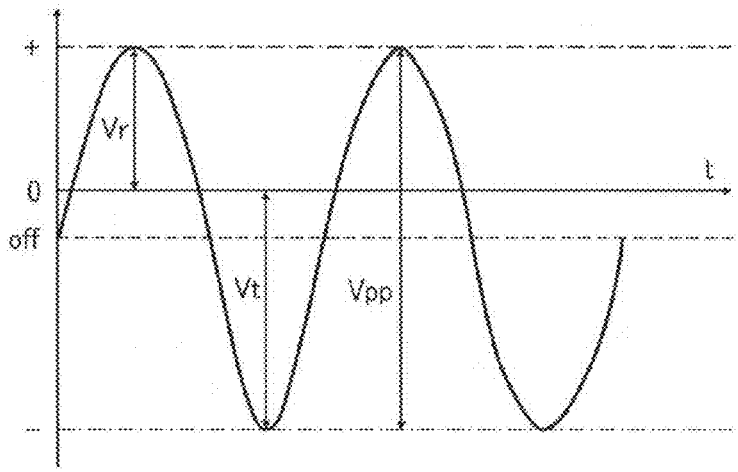
FIG. 4 is a graph illustrating one example of a waveform of a superposed bias outputted from an alternating current power supply used in one embodiment of the present invention.

FIG. 4 illustrates one example of a waveform of the superposed bias outputted from the alternating current power supply 202. In the drawing, an offset voltage Voff is a direct current component of the superposed bias. A peak to peak voltage Vpp is a peak to peak voltage of the alternating current component of the superposed bias. The superposed bias is obtained by superimposing the offset voltage Voff on the peak to peak voltage Vpp, and a mean value is equivalent to the offset voltage Voff. As shown in the drawing, the superposed bias has a sine wave shape and includes peak values on positive and negative sides, respectively. A value Vt is one of these two peaks (i.e., a negative side in this embodiment) to move toner from a belt side to a recording sheet side in the secondary transfer nip. Whereas, a value Vr is a peak value (on the positive side in this embodiment) to return the toner from the recording sheet side to the belt side. By applying the superposition bias including the direct current component, and equalizing a polarity (e.g., a negative polarity in this embodiment) of the offset voltage Voff as a time average with that of the toner, the toner reciprocates and is relatively moved and transferred from the belt side to the recording sheet side. Although the sine wave shape is adopted as the alternating current voltage, a rectangular wave shape may be used.

When a recording sheet, such as a Japanese sheet like sheet, an embossed sheet, etc., having a large uneven surface is used, the superposition bias is applied to cause toner thereon to reciprocate and is relatively moved and transferred from the belt side to the recording sheet side. Consequently, transfer performance is upgraded and a transfer rate of transferring toner onto a concave portion of a sheet is improved, so that abnormal image, such as spotting, etc., can be suppressed. By contrast, when a recording sheet having a conventional small uneven surface is used, sufficient transfer performance can be obtained even if a secondary transfer bias only with the direct current component is applied.

Further, this embodiment employs both a direct current transfer mode in which image transfer operation is executed by applying a direct current bias as a secondary transfer bias, and a superposed transfer mode in which the image transfer operation is executed by applying the superposed bias created by superposing an alternating current on a direct current, and is enabled to switch these modes. Further, by switching between the direct current transfer and superposed transfer modes depending on a type of a sheet to be fed, an image is appropriately transferred both onto the sheets with large and small uneven surfaces, respectively. Such switching between the transfer modes may be either automatically executed when the type of the sheet is designated or is executed when a user designates a transfer mode. In any way, such setting is executed through an operation panel, not shown, provided in the color printer 100.

Figure 5:
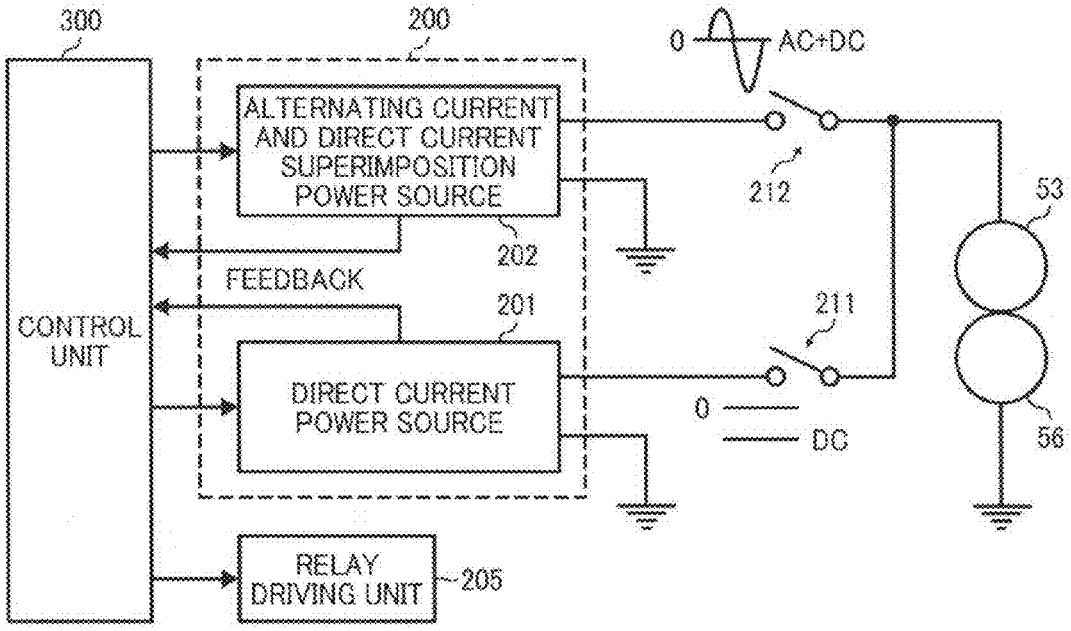
FIG. 5 is a diagram illustrating an exemplary configuration of a secondary transfer-bias applying unit used in the one embodiment of the present invention.

Now, an exemplary configuration of a secondary transfer bias applying unit employed in one embodiment of the present invention is described with reference to FIG. 5. As shown, the power supplies applying biases are switched using a pair of relays. Specifically, the direct current power supply 201 applies the direct current bias to the secondary transfer opposed roller 53 via a relay 211. Whereas, the alternating current power supply 202 applies the superposed bias to the secondary transfer opposed roller 53 through a relay 212. Connection and insulation of each of the relays 211 and 212 is controlled by a control unit 300 via a relay-driving device 205, so that the superposed bias and the direct current bias are switched and applied as the secondary transfer bias. A feedback voltage is outputted from each of the direct current power supply 201 and the alternating current power supply 202 toward the control unit 300. In this embodiment, a resistance (e.g., a resistance including a sheet and an intermediate transfer belt 51) at the secondary transfer section is calculated based on the feedback voltage provided from the direct current power supply 201 and determines a transfer current value to execute constant-current control in the direct current transfer mode, in which image transfer operation is executed by applying direct current bias as the secondary transfer bias.

Now, a configuration of the secondary transfer section employed in this embodiment is described more in detailed with reference to FIG. 6. Since the intermediate transfer belt 51 as an image bearing member contacts the secondary transfer roller 56 as a transferring member, toner as background stain and a process pattern borne on the intermediate transfer belt 51 are transferred onto either a portion of the secondary transfer roller 56, through which a transfer medium, such as a transfer sheet, etc., does not pass, or that corresponding to an interval between the transfer sheets thereby contaminating thereof. Therefore, by always removing the toner on the secondary transfer roller 56 with a cleaning blade 60 as a cleaner, back side stain of the transferring member is prevented. Further, when corona products are produced and adhere to the secondary transfer roller 56 in the superposed transfer mode, the cleaning blade 60 again scrapes off and prevents the toner from depositing thereon.

A paper powder removal-brush roller 63 is provided as a secondary brush roller on the upstream side of the cleaning blade 60 in a direction of rotation of the secondary transfer roller 56. The paper powder removal-brush roller 63 functions to prevent the sheet dust from being pinched by the cleaning blade 60 and scrapes off the toner therefrom in the superposed transfer mode.

An application device 5 is provided on the downstream side of the cleaning blade 60 in a direction of rotation of the secondary transfer roller 56 to apply protective agent to the secondary transfer roller 56. The application device 5 includes solid surface protective agent 62, a first brush roller 61 to contact, scrape off, and apply the solid surface protective agent 62 to a surface of the secondary transfer roller 56, and a pressurized spring 64 for pressing the solid surface protective agent 62 against the brush roller 61 under given pressure, or the like. The brush roller 61 contacts the secondary transfer roller 56 via their respective surfaces, and is driven and rotated at a predetermined speed, by a motor, not shown, in the same direction as the secondary transfer roller 56 rotates.

As the solid surface protective agent 62, dry solid-hydrophobic lubricant of relatively higher fatty acid, such as zinc stearate, barium stearate, zinc stearate, stearic acid iron, stearic acid nickel, oleic acid zinc, oleic acid manganese, oleic acid lead, copper palmitic acid, caproic acid lead, linolenic acid zinc, etc. is used as a typical example. Further, natural wax, such as carnauba wax etc., is also used.

In this embodiment, the solid surface protective agent 62 needs a low abrasive not to scratch the surface of the secondary transfer roller 56 and should be entirely uniformly applied onto the surface of the secondary transfer roller 56 while forming a thin film thereon. Thus, zinc stearate molded in a block state having a low friction coefficient generally used as lubricant is used. The brush roller 61 extends in an axial direction of the secondary transfer roller 56. The solid surface protective agent 62 is slideable and is arranged in a case 65 and is biased by a pressurized spring 64 against the brush roller 61 to be entirely used up. Since the solid surface protective agent 62 is a consumable item, its thickness decreases as time elapses. However, since it is pressed by the pressurized spring 64, the solid surface protective agent 62 always contacts the brush roller 61 under predetermined pressure, a predetermined amount thereof is scraped and is coated on the secondary transfer roller 56. Since the brush roller 61 is composed by polyester fibers, a bristle of the brush roller 61 does not fall down and an outer diameter thereof does not decrease even though an endurance test for three hundred thousand sheets is practiced. Accordingly, the solid surface protective agent 62 can be constantly applied to the secondary transfer roller 56 for a long time. Further, a length of each of the above-described members in the longitudinal direction is determined to meet the following inequality; Width of cleaning blade 60>Width of solid surface protective agent 62>Width of brush roller 61.

By establishing such a relation, the solid surface protective agent 62 shaved by the brush roller 61 is uniformly coated over the cleaning blade 60 to prevent corona products from bonding thereto while keeping a low friction thereof. Accordingly, cleaning performance can be improved preventing entrapment of the blade.

As a method of applying the solid surface protective agent 62 other than that employed in this embodiment, the solid surface protective agent 62 can be either coated via the paper powder removing brush roller 63 disposed upstream of the cleaning blade 60, or applied by directly bringing it in contact with the secondary transfer roller 56 on a downstream side of the cleaning blade 60. However, when the solid surface protective agent 62 is pressed against the paper powder removing brush roller 63 disposed upstream of the cleaning blade 60, some toner is present on the paper powder removing brush roller 63 as a result of scraping the toner from a surface of the secondary transfer roller 56. Consequently, the toner is not uniformly (inputted and) borne on the bush roller 61. Since the toner on the brush roller 61 acts as abrasives when the solid surface protective agent 62 is scraped, and a greater amount of the solid surface protective agent 62 is shaven in a section (of the brush roller) where a large amount of the toner is (inputted and) borne, an amount of toner applied onto the secondary transfer roller 56 varies due to a difference in an amount of the toner (inputted and) borne thereon, so that the solid surface protective agent 62 cannot be constantly and uniformly applied thereto. Whereas, when the solid surface protective agent 62 directly contacts and is coated on the downstream side of the cleaning blade 60, and foreign material enters a gap between the solid surface protective agent 62 and the secondary transfer roller 56, the foreign material is buried into the solid surface protective agent 62. Consequently, there are problems in that the foreign material cuts the secondary transfer roller 56 causing defective cleaning and/or necessitates frequent replacement of the secondary transfer roller 56. Further, since a condition of the surface of the secondary transfer roller 56 changes (e.g., roughened) and an application amount of the surface protective agent 62 also varies as time elapses, the application amount of the surface protective agent 62 cannot be appropriately maintained.

Now, a result of image formation of one hundred thousand of sheets in each of a direct current transfer mode and a superposition transfer mode while changing a rotation speed of the brush roller 61 described with reference to FIG. 12. Specifically, as shown, by changing an rpm of the brush roller 61 between 200 rpm, 400 rpm, and 600 rpm, a shaven amount of solid surface protective agent 62 is changed, and accordingly an amount of solid surface protective agent 62 coated onto a surface of the secondary transfer roller 56 is changed. Although it is not entirely applied to the secondary transfer roller 56 actually, a shaven amount of the solid surface protective agent 62 defines a coated amount thereof onto the secondary transfer roller 56.

An application amount of the protective agent 62 is measured by identifying an amount of the solid surface protective agent 62 shaven per surface movement of 1,000 m of the secondary transfer roller 56 per unit length in a direction perpendicular to a rotation direction of the brush roller. Specifically, weight of an initial state of the solid surface protective agent 62 is measured and is set to a color printer 100. Multiple test images are continuously outputted onto multiple recording sheets until an amount of surface displacement of the secondary transfer roller 56 reaches the length of 1000 m. After that, the solid surface protective agent 62 is removed from a tester, and its weight is measured. The weight thus measured after the continuous outputting is deducted from the initial weight. A result of the subtraction is divided by the unit length in the direction perpendicular to the rotation direction of the brush roller 61 at a contact between the brush roller 61 and the solid surface protective agent 62 to obtain a consumption amount thereof. According to this embodiment of the color printer 100, since an inequality (i.e., Solid surface protective agent 62<Brush roller 61) is established and the solid surface protective agent 62 has a length of 33 cm, a result of the above-described subtraction is then divided by 33 cm.

In the direct current transfer mode, even when the number of revolutions of the brush roller 61 is 200 rpm, the backside stain or the cloud generally occurring due to adhesion of the corona products onto the surface of the secondary transfer roller 56 does not occur. Whereas in the superposed transfer mode, the surface of the secondary transfer roller 56 becomes clouded while the corona products sticks to the secondary transfer roller 56. Consequently, a friction coefficient of the surface of the secondary transfer roller 56 increases, and an image with backside stain is recognized due to deterioration of cleaning performance. Whereas, when the number of revolutions of the brush roller 61 is set to 400 rpm, neither the adhesion of the corona products is recognized nor the surface of the secondary transfer roller 56 becomes clouded. However, the friction coefficient of the surface of the secondary transfer 56 continuously tends to increase when compared with that in the direct current transfer mode, and the image of the backside stain is recognized due to deterioration of cleaning performance. Further, when the number of revolutions of the brush roller 61 is 600 rpm, the friction coefficient of the surface of the secondary transfer 56 does not increase to a high level also in the superposed transfer mode, the image with backside stain generally caused by deterioration of cleaning performance is not recognized.

Further, a cause of increasing in friction coefficient of the surface of the secondary transfer roller 56 in the superposed transfer mode is investigated, and the below described facts are revealed. Specifically, when a voltage generated by superimposing a direct current voltage on an alternating current voltage as a transfer bias, since discharging operation is repeated between the intermediate transfer belt 51 and the secondary transfer roller 56 depending on a frequency of the alternating current voltage, a hazard grows, and a molecular structure and surface energy of the solid surface protective agent 62 changes and lubricity is lost, so that the solid surface protective agent 62 is gradually scraped and finally disappears. Because of this, by increasing an application amount of the surface protective agent 62 and supplying greater amount thereof than that of the hazard, the friction coefficient of the surface of the secondary transfer roller 56 can be kept at a relatively low level.

Since an application amount of the protective agent needed in the superposed transfer mode is about three times of that needed in the direct current transfer mode, if the number of revolutions of the brush roller 61 is determined in accordance with the necessary amount of the surface protective agent 62 in the superposed transfer mode, a life of the surface protective agent 62 becomes significantly shorter. Accordingly, by correspondingly changing and optimizing the number of revolutions of the brush roller 61 both in the direct current transfer mode and the superposed transfer mode, the life of the solid surface protective agent 62 can be prolonged. Further, by respectively counting the number of usage times both in the superposed transfer mode and the direct current transfer mode, and setting the lifetime of the surface protective agent 62 depending on a used percentage counted in this way, variation of the life caused depending on a used percentage of the mode is corrected, and a cycle of replacing the solid surface protective agent 62 can be appropriate.

Hence, in this embodiment, a necessary application amount of the protective agent in the superposed transfer mode is obtained (secured) by changing the rpm of the brush roller 61. However, the amount of the protective agent of the solid surface protective agent 62 can be varied by adjusting the pressure spring 64 pressing the solid surface protective agent 62 against the brush roller 61 thereby varying a contact pressure between the solid surface protective agent 62 and the brush roller 61. In this situation, the contact pressure is designed to be higher in the superposed transfer mode. The similar effect as described above can be obtained also in this system.

Figures 8, 9:
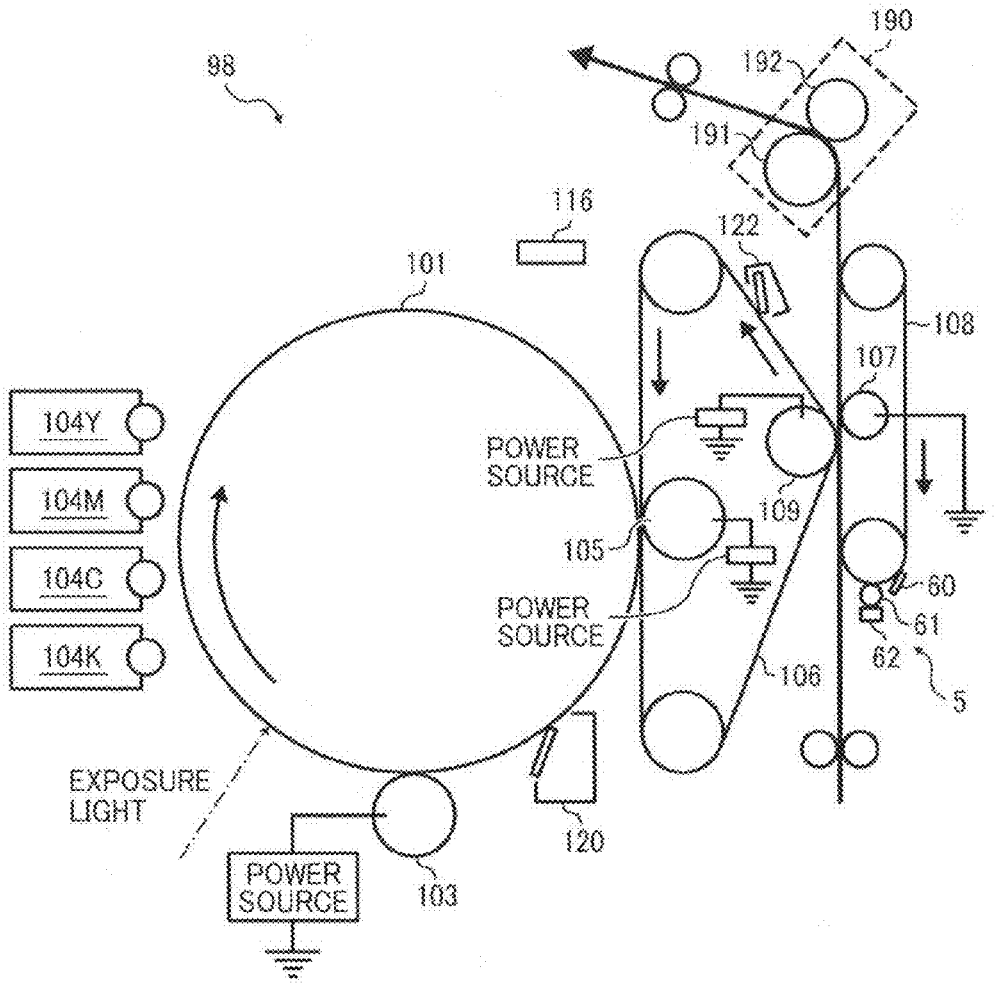
FIG. 8 is a schematic diagram illustrating a third embodiment of the present invention.
FIG. 9 is a table illustrating results of an experiment conducted with one embodiment of the present invention.

Further, the solid surface protective agent 62 is cut into two so that a surface protective agent application area and a surface protective agent non-application area are formed in the color printer 100. Then, ten thousand times of image formation are executed in each of the direct current transfer mode and the superposition transfer mode, and results of the image formation are investigated as shown in FIG. 9. As shown, in the direct current transfer mode, at each of the surface protective agent non-application and application areas, neither a white line image nor an image having backside stain occurs. Similarly, in the superposed transfer mode, at the surface lubricant application area, neither the white line image nor the image having backside stain is recognized as in the direct current transfer mode. However, the surface of the transfer roller is clouded in the non-application area and adhesion of the corona products to the transfer roller is recognized in the superposed transfer mode. At the same time, the image with backside stain caused by deterioration of cleaning performance and the white line image caused by a transfer current concentrating at one point are recognized. Based on these results, it is understood that occurrence of an abnormal image can be prevented in the superposed transfer mode by applying and forming a thin film of the surface protective agent 62 onto the surface of the transfer roller.

Figure 7:
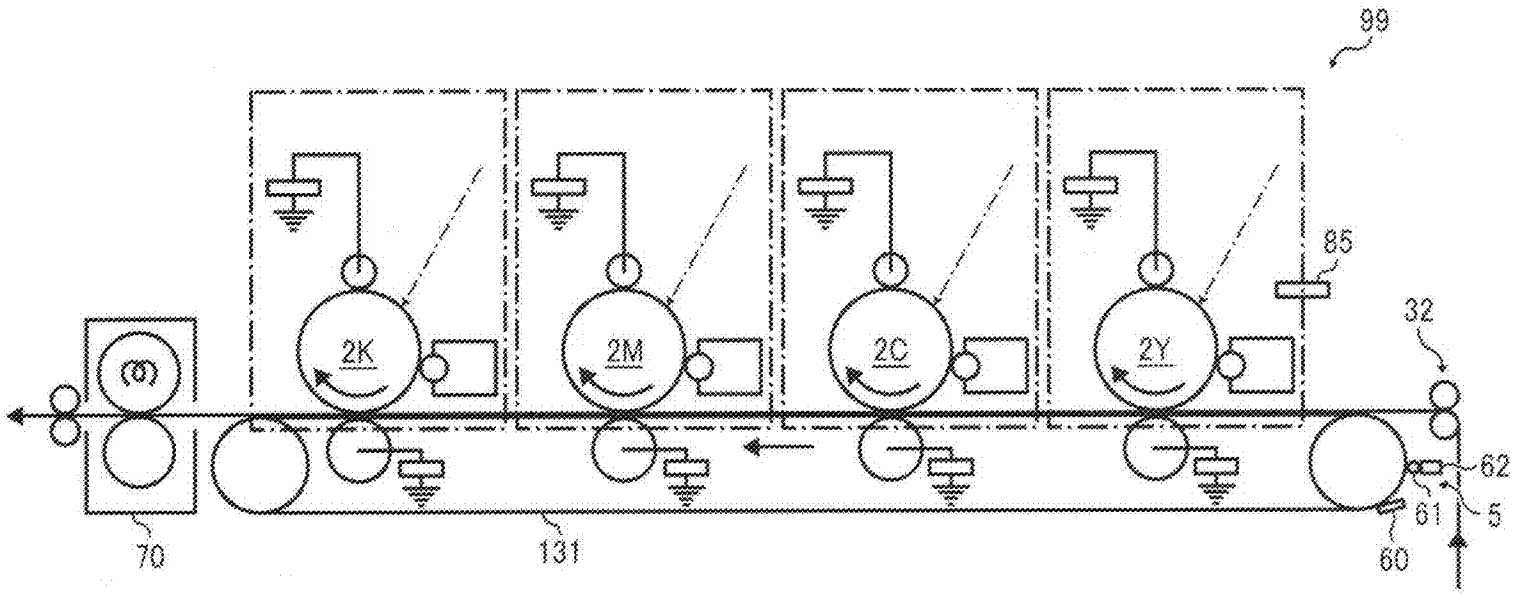
FIG. 7 is a schematic diagram illustrating a second embodiment of the present invention.

Further, the present invention is not limited to the image forming apparatus employing the intermediate transfer system (i.e., an indirect transfer system), and may be applied to an image forming apparatus employing a direct transfer system to directly transfer a toner image from a photoreceptor onto a recording sheet as shown in FIG. 7. Specifically, the recording sheet is sent onto a conveyor belt 131 by a sheet feed roller 32 in a color printer 99 as the image forming apparatus, and each color image is directly transferred from each of color photoconductive drums 2Y, 2C, 2M, and 2K onto the recording sheet, sequentially, and is fixed by a fixing device 70. Further, a pair of power supplies, such as an alternating current power supply that applies an alternating current bias (e.g., alternating current and direct current superposed bias) to each transfer section, a direct current power supply that applies a direct current bias to each transfer section, etc., is provided, so that the direct current bias and the superposed bias can be switched to be applied. On a surface of the conveyor belt 131, a cleaning blade 60 is provided. On a downstream side of the cleaning blade 60 in a belt running direction, the solid surface protective agent 62 and the brush roller 61 contacting and scraping off the solid surface protective agent 62 to apply the solid surface protective agent 62 to a surface of the conveyor belt are provided as an application device 5. Again, the similar effects as described above can be obtained in this modification.

Further, this invention may be applied to a so-called one drum type color image forming apparatus as well as shown in FIG. 8. Specifically, a color image forming apparatus 98 includes a discharger 103 and developing units 104Y, 104 C, 104 M, 104 K corresponding to colors of yellow, cyan, magenta, and black or the like around one photoconductive drum 101. When image formation is executed, a surface of the photosensitive drum 101 is uniformly charged by the charger 103, and a laser beam L modulated by yellow image data is emitted onto the surface of the photosensitive drum 101, so that an electrostatic latent image for yellow is formed on the surface of the photosensitive drum 101. Further, the electrostatic latent image for yellow is developed by the developing unit 104 Y with yellow toner. The yellow toner image obtained by this way is primarily transferred onto the intermediate transfer belt 106. Subsequently, after removing the post transfer residual toner remaining on the surface of the photosensitive drum 101 with a cleaner 120, the surface of the photosensitive drum 101 is uniformly charged again by the charger 103. Subsequently, applied laser light L modulated by magenta image data is emitted onto the surface of the photosensitive drum 101 thereby forming a magenta electrostatic latent image on the surface of the photosensitive drum 101. Further, the electrostatic latent image for magenta is developed by the developing unit 104M with magenta toner. The magenta toner image thus obtained in this way is primarily transferred onto the intermediate transfer belt 106 while overlapping with the yellow toner image having been primarily transferred onto the intermediate transfer belt 106. Thereafter, primarily transfer is similarly executed for cyan and black as well as on the intermediate transfer belt 106. Color toner images overlapping with each other on the intermediate transfer belt 106 in this way are is transferred onto the recording sheet transferred onto the secondary transfer belt. The recording sheet with the toner image transferred is then transported to the fixing unit 190, so that the toner image is entrenched onto the recording sheet when heated and squeezed in the fixing unit 190. The recording sheet is then ejected onto a sheet exit tray, not shown, after the fixing process.

Also, in this color image forming apparatus 98, an alternating current power supply that applies an alternating current bias (an alternating current and direct current superposed bias) and a direct current power supply that applies a direct current bias are provided as a power supply unit to apply a transfer bias to a second transfer section. The superposed bias and the direct current bias can be switched and are alternately applied to the second transfer section. Further, on a surface of the conveyor belt 108, a cleaning blade 60 is provided. On a downstream side of the cleaning blade 60, a solid surface protective agent 62 and a brush roller 61 contacting and scraping off the solid surface protective agent 62 to supply solid surface protective agent 62 to a surface of the conveyor belt 131 are provided as an application device 5. Again, the similar effects as described above can be obtained also in this modification.

In the above-described embodiment, the secondary transfer roller 56 is grounded while a second transfer bias is applied from the secondary transfer bias power supply 200 to the secondary transfer opposed roller 53 as an opposed member. However, the second transfer opposed roller 53 can be grounded while the second transfer bias is applied from the secondary transfer bias power supply 200 to the secondary transfer roller 56.

Figure 10:
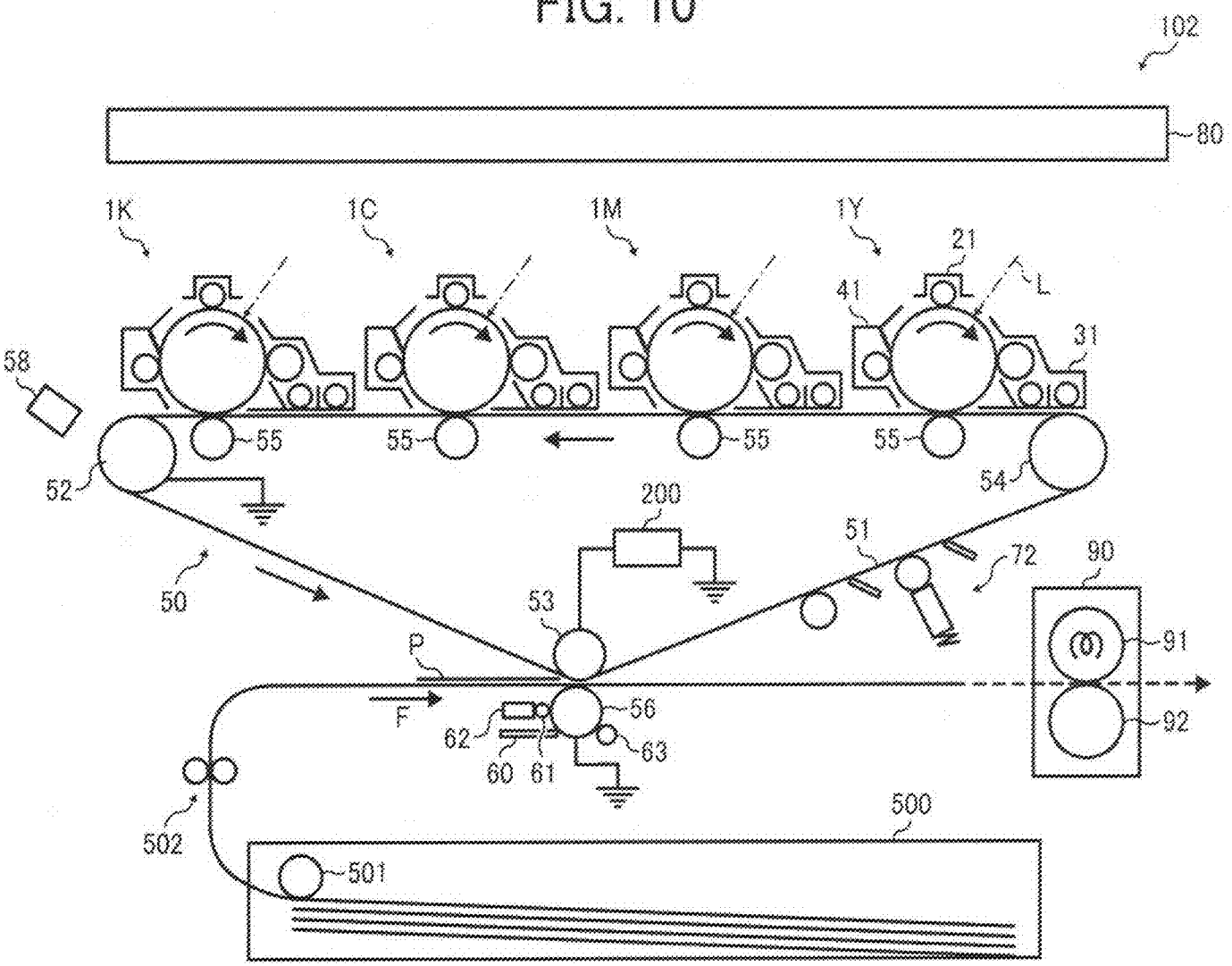
FIG. 10 is a schematic diagram illustrating an image forming apparatus to which another embodiment of the present invention is applied.

Now, another embodiment of the present invention is described with reference to FIGS. 10 to 12. As shown in FIG. 10, a color printer 102 as an image forming apparatus is only different from the color printer 100 of the above-described embodiment by including a belt cleaning unit 72 instead of the belt cleaning unit 57 of the above-described the embodiment and the other configurations are substantially the same. Specifically, as shown in FIG. 11, the belt cleaning unit 72 includes a cleaning blade 73 as a second cleaner, a second applicator 6, a paper powder removal brush roller 74 as a fourth brush roller, and an application blade 75 as a contact member or the like. Since residual toner remains on the intermediate transfer belt 51 after a secondary transfer process, the cleaning blade 73 constantly removes the residual toner from the intermediate transfer belt to prevent stain of an image. Further, even when corona products are generated and adhere to the surface of the intermediate transfer belt 51 during the superposed transfer mode, in which the alternating current is superimposed on the direct current, the cleaning blade 73 scrapes off the corona products therefrom thereby capable of preventing accumulation thereof.

A paper powder removal brush roller 74 is disposed on the upstream side of the cleaning blade 73 in a belt running direction. The paper powder removal-brush roller 74 prevents sheet dust from entering the cleaning blade 73 and being pinched therein and scrapes off the corona products during the superposed transfer mode.

A second application device 6 is disposed on the downstream side of the cleaning blade 73 in the belt running direction to apply protective agent onto a surface of the intermediate transfer belt 51. The second application device 6 includes a similar solid surface protective agent 62 as employed in the above-described embodiment, a third brush roller 76 similar to brush roller 61 as employed in the above-described embodiment, and a pressure spring 64 or the like. The brush roller 76 contacts a surface of the intermediate transfer belt 51 via its surface and is driven and rotated as the intermediate transfer belt 51 travels and moves. On the downstream side of the second application device 6 in the belt running direction, an application blade 75 is provided to flatten the solid surface protective agent adhered to the intermediate transfer belt 51 in a powdery state.

In this embodiment, the solid surface protective agent 62 needs to have a low abrasive not to scratch the surface of the intermediate transfer belt 51, and should be uniformly coated on the surface thereof entirely in a thin film state. The solid surface protective agent 62 employs zinc stearate molded in a block state as also generally used as low friction coefficient lubricant. The brush roller 61 extends in a widthwise direction of the intermediate transfer belt 51. The solid surface protective agent 62 is biased toward the brush roller 61 by a pressure spring 64 to be entirely consumed.

The image with backside stain and the cloud caused by attraction of the corona products to the surface of the intermediate transfer belt 51 did not occur in the direct current transfer mode. However, in the superposed transfer mode, a surface of the intermediate transfer belt 51 is clouded by the attraction of the corona products, and a friction coefficient of the surface of the intermediate belt transfer 51 increases thereby degrading the cleaning performance thereof. As a result, an image having backside stain is generated.

Further, a cause of increasing in friction coefficient of the surface of the intermediate belt transfer 51 during the superposed transfer mode is investigated, and the below described facts are known. Specifically, when the alternating current voltage is superimposed onto a direct current voltage as a transfer bias and is used, since discharging operation is repeated between the intermediate transfer belt 51 and the secondary transfer roller 56 in accordance with a frequency of the alternating current voltage, a hazard grows. Accordingly, a molecular structure and surface energy of the solid surface protective agent 62 change and lubricity thereof is lost, so that the solid surface protective agent 62 is gradually scraped and finally disappears. Because of this, by increasing an amount of the surface protective agent 62 and supplying a greater amount of the solid surface protective agent 62 than that of the hazard, the friction coefficient of the surface of the intermediate belt transfer 51 can be kept at a low level.

When the number of revolutions of the brush roller 61 is determined in accordance with the amount of protective agent needed during the superposed transfer mode, the life of the solid surface protective agent 62 becomes significantly shorter, because the more protective agent is needed during the superposed transfer mode than during the direct current transfer mode. Accordingly, by changing and optimizing the number of revolutions of the brush roller 61 in accordance with a direct current or superposed transfer mode, the life of the solid surface protective agent 62 can be prolonged. Further, by respectively counting the usage number of sheets in each of the direct current transfer mode and the superposed transfer mode, and setting the lifetime of the surface protective agent 62 in accordance with a used percentage (i.e., a counted value), a variation in the life caused by the used percentage of the mode is corrected, so that a replacement cycle of the solid surface protective agent 62 can be appropriate.

In this embodiment, a necessary amount of the protective agent in the superposed transfer mode is secured by changing the rpm of the brush roller 61. However, the amount of the solid surface protective agent 62 can be varied by adjusting the pressure spring 64 pressing the solid surface protective agent 62 against the brush roller 61 thereby varying a contact pressure between the solid surface protective agent 62 and the brush roller better 61. In such a situation, the contact pressure is designated higher in the superposed transfer mode. Also in this system, the similar effect as described above can be obtained.

In this embodiment, a necessary amount of the protective agent in the superposed transfer mode is secured by changing the rpm of the brush roller 61. However, the amount of the solid surface protective agent 62 can be varied by adjusting the pressure spring 64 pressing the solid surface protective agent 62 against the brush roller 61 thereby varying a contact pressure between the solid surface protective agent 62 and the brush roller better 61. In such a situation, the contact pressure is designated higher in the superposed transfer mode. Also in this system, the similar effect as described above can be obtained.

According to one embodiment of the present invention, an abnormal image, such as a white line, backside stain, etc., generally formed on an image can be reduced even in a superposed transfer mode.

Numerous additional modifications and variations of the present invention are possible in light of the above teachings. It is therefore to be understood that within the scope of the appended claims, the present invention may be practiced otherwise than as specifically described herein.

What is claimed is:

1. A transfer device comprising:

a freely rotatable transferring member contacting an image bearing member to form a transfer nip;

a transfer bias applying member to transfer a toner image borne on the image bearing member onto a recording medium in the transfer nip by applying a first bias that is created by superimposing an alternating current component on a direct current component; and an applicator to apply a protective agent to a surface of the transferring member, wherein the transfer bias applying member selectively applies either the first bias or a second bias composed only of the direct current component, wherein the applicator applies more protective agent when the first bias is applied than when the second bias is applied.

2. The transfer device as claimed in claim 1, wherein the applicator includes a rotatable application element in contact with both the protective agent and the transferring member to scrape off and apply the protective agent to the transferring member.

3. The transfer device as claimed in claim 2, wherein a rotational speed of the application element is increased when at least the first bias is applied.

4. The transfer device as claimed in claim 2, wherein pressure of contact between the application element and the protective agent is increased when at least the first bias is applied.

5. The transfer device as claimed in claim 2, wherein the application element is a first brush roller.

6. The transfer device as claimed in claim 5, wherein the first brush roller is made of polyester fiber.

7. The transfer device as claimed in claim 5, further comprising a cleaner to clean the transferring member.

8. The transfer device as claimed in claim 7, further comprising a second brush roller disposed in contact with the surface of the transferring member on an upstream side of the cleaner in a direction of rotation of the transferring member.

9. The transfer device as claimed in claim 1, wherein the protective agent is zinc stearate.

10. The transfer device as claimed in claim 1, wherein at least a surface of the transferring member is made of fluorine resin.

11. An image forming apparatus comprising:

an image bearing member; and a transfer device, comprising:

a freely rotatable transferring member contacting an image bearing member to form a transfer nip;

a transfer bias applying member to transfer a toner image borne on the image bearing member onto a recording medium in the transfer nip by applying a first bias that is created by superimposing an alternating current component on a direct current component;

a first applicator to apply a first protective agent to a surface of the transferring member;

a cleaner to contact and clean a surface of the image bearing member; and a second applicator to apply a second protective agent to the surface of the image bearing member, wherein the transfer bias applying member selectively applies either the first bias or a second bias composed only of the direct current component, wherein the second applicator applies more second protective agent when the first bias is applied.

12. The image forming apparatus as claimed in claim 11, wherein the second applicator includes a second rotatable application element in contact with both the second protective agent and the image bearing member to scrape off and apply the second protective agent to the image bearing member.

13. The image forming apparatus as claimed in claim 12, wherein a rotational speed of the second application element is increased when at least the first bias is applied.

14. The image forming apparatus as claimed in claim 12, wherein the pressure of contact between the second application element and the second protective agent is increased when at least the first bias is applied.

15. The image forming apparatus as claimed in claim 12, wherein the second application element is a third brush roller.

16. The image forming apparatus as claimed in claim 15, wherein the third brush roller is made of polyester fiber.

17. The image forming apparatus as claimed in claim 11, wherein the second protective agent is zinc stearate.

18. An image forming apparatus comprising:

an image bearing member;

a transferring member contacting the image bearing member to form a transfer nip;

a transfer bias applying member to transfer a toner image borne on the image bearing member onto a recording medium in the transfer nip by selectively applying either a first bias that is created by superimposing an alternating current component on a direct current component or a second bias composed only of the direct current component; and an applicator to apply a protective agent to a surface of the image bearing member, wherein the applicator applies more protective agent when the first bias is applied than when the second bias is applied.

19. The image forming apparatus as claimed in claim 18, further comprising:

a cleaner to contact and clean the surface of the image bearing member.

* * * * *